US005232160A

United States Patent [19]

Hendrickson et al.

[11] Patent Number: 5,232,160

[45] Date of Patent: Aug. 3, 1993

[54] MULTIPLE-OUTLET IRRIGATION DEVICE AND REGULATOR

[75] Inventors: Donald L. Hendrickson, Mira Loma; Glendale Grizzle, Corona, both of Calif.

[73] Assignee: Hendrickson Bros., Corona, Calif.

[21] Appl. No.: 863,864

[22] Filed: Apr. 6, 1992

Related U.S. Application Data

[63] Continuation-in-part of Ser. No. 797,423, Nov. 22, 1991, abandoned.

[51] Int. Cl.[5] ..... B05B 1/30; B05B 15/06

[52] U.S. Cl. ..... 239/276; 239/285; 239/444; 239/562

[58] Field of Search ..... 239/542, 551, 562, 276, 239/273, 275, 280, 285, 444

[56] References Cited

U.S. PATENT DOCUMENTS

| | | | |
|---|---|---|---|
| 1,031,176 | 7/1912 | Gilpin | 239/285 |
| 2,535,723 | 12/1950 | Coombs | 239/285 |
| 3,547,351 | 12/1970 | Hruby | 239/338 |
| 3,758,040 | 9/1973 | Howard | 239/550 |
| 3,810,582 | 5/1974 | Lodge | 239/542 |
| 3,863,845 | 2/1975 | Bumpstead | 239/542 |
| 3,994,441 | 11/1976 | Testa | 239/276 |
| 4,085,895 | 4/1978 | Curry et al. | 239/285 |
| 4,166,576 | 9/1979 | Harrison | 239/11 |
| 4,221,335 | 9/1980 | Shames | 239/428.5 |
| 4,223,840 | 9/1980 | LaScala et al. | 239/542 |
| 4,226,368 | 10/1980 | Hunter | 239/542 |
| 4,289,167 | 9/1981 | Switall | 239/562 X |
| 4,613,080 | 9/1986 | Benson et al. | 239/542 |
| 4,660,769 | 4/1987 | Rosenberg | 239/542 |
| 4,753,394 | 6/1988 | Goodman | 239/542 |
| 4,913,352 | 4/1990 | Witty | 239/104 |
| 5,054,690 | 10/1991 | Olson | 239/542 |
| 5,137,216 | 8/1992 | Hanish | 239/542 |

FOREIGN PATENT DOCUMENTS

| | | | |
|---|---|---|---|
| 264742 | 4/1988 | European Pat. Off. | 239/551 |
| 2728264 | 1/1979 | Fed. Rep. of Germany | 239/542 |

OTHER PUBLICATIONS

Raindrip, Inc., "Drip Hydrant", packaging material of the Raindrip Corporation, 1990.

Bowsmith, Inc., "The Bowsmith Nonstop Emitter", promotional material of the Bowsmith Corporation.

Pepco Water Conservation Products, Inc.., "Water Conservation Handbook", promotional materials of Water Conservation Products, Inc.

Hit Products Corporation, "Multi-Port Emitter Pressure Compensating", product bulletin of Hit Products Corporation.

Agrifim Irrigation Products, Inc., "Maxi-Flow Drip Bubbler", promotional materials of Agrifim Irrigation Products, Inc., 1991.

Agrifim Irrigation Products, Inc., "1992 Product Catalog and Price List", promotional material of Agrifim Irrigation Products, Inc., 1991.

Olson Irrigation Systems, "EH-12 Vibra-Clean Emitter Head", promotional material of Olson Irrigation Systems, 1991.

Salco Products, Inc., "Drip Irrigation Systems", promotional material of Salco Products, Inc.

Bowsmith, Inc., "Bowsmith 'Series 2000' Flow Distributor", promotional material of Bowsmith, Inc.

Drip Irrigation Supply Co., Inc. "1990 Drip Irrigation Product Line", promotional material of the Drip Irrigation Supply Company, 1990.

*Primary Examiner*—Andres Kashnikow
*Assistant Examiner*—Lesley D. Morris
*Attorney, Agent, or Firm*—Knobbe, Martens, Olson & Bear

[57] ABSTRACT

A pressure reducer positioned in the lower portion of a housing reduces the inlet pressure of a source of irrigation water. The lower pressure liquid is ducted to a plurality of conduits, and the flow of water through these conduits is adjustable by individual valves supported on stakes positioned remote from the housing and connected to the conduits. A canister surrounds and supports an inlet riser connected to the housing, and a cup shaped cover fits onto the canister and encloses the housing.

22 Claims, 7 Drawing Sheets

FIG. 5
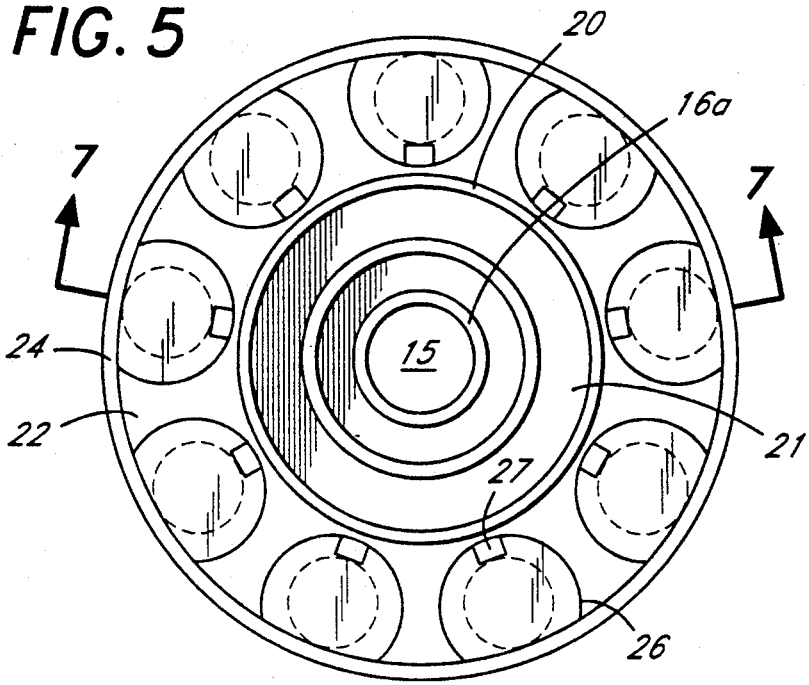
FIG. 6
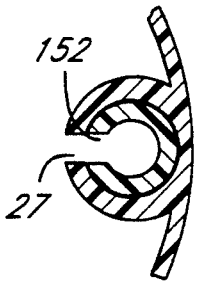
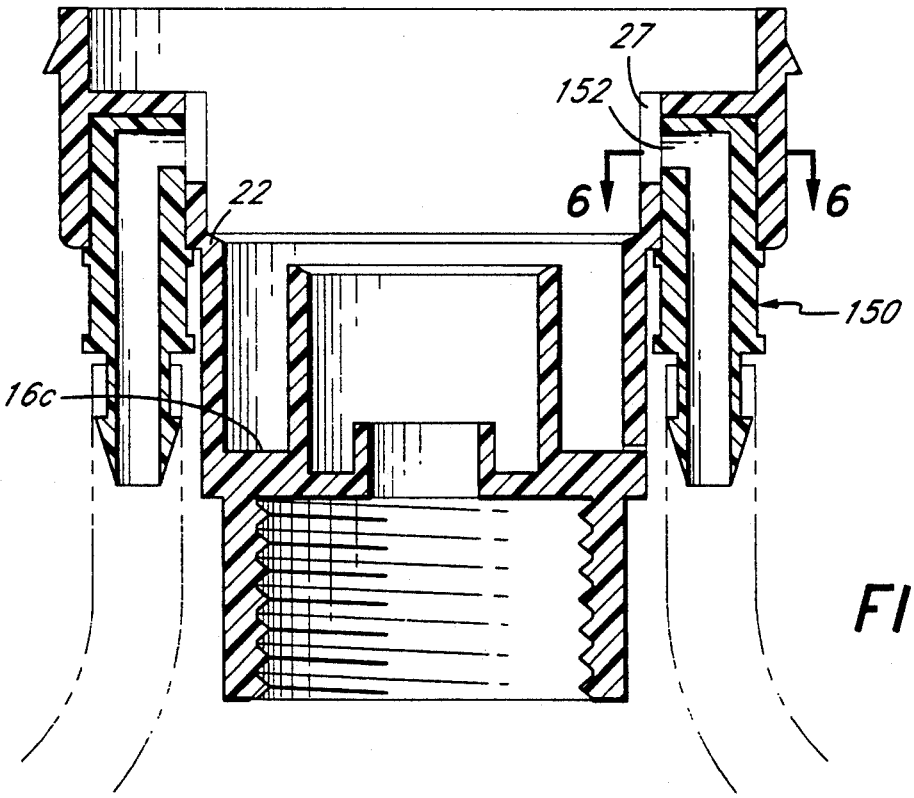
FIG. 7

MULTIPLE-OUTLET IRRIGATION DEVICE AND REGULATOR

RELATED APPLICATION

This is a continuation-in-part of U.S. application Ser. No. 797,423, filed Nov. 22, 1991, now abandoned.

FIELD OF THE INVENTION

The present invention relates to an irrigation device wherein an inlet water supply is reduced in pressure and then distributed to multiple outlets.

BACKGROUND OF THE INVENTION

Various devices are known in the prior art which receive water under pressure from a supply line, lower the pressure of such water, and then distribute it to a plurality of locations. For example, U.S. Pat. No. 3,810,582 discloses an irrigation device having a tubular manifold body which may be attached to the riser of an irrigation system. This device lowers the pressure and controls the flow of incoming water by means of a specially formed valve at the water inlet. The lower pressure water is then distributed through a plurality of outlet ports connected to small diameter irrigation tubes which conduct the water to a desired location.

Another drip irrigation device is disclosed in U.S. Pat. No. 3,863,845 wherein the incoming water flows along an extended path before being distributed to a plurality of tubes. The long flow path lowers the pressure of the entering water so that low pressure water is delivered to the irrigation tubes.

U.S. Pat. No. 4,753,394 discloses a drip irrigation device employing a float to shut off the flow of water into an interior chamber of the device when that chamber is filled. The effective pressure of the water flowing through irrigation hoses connected to the device is therefore determined by a pressure head, which results from the height difference between the water level in the chamber and the level of outlet ports.

There remains a need, however, for a drip irrigation device which provides for more control over the flow of water to each of a plurality of desired locations. Further, there remains a need for an irrigation device which automatically compensates for increases in the pressure of water flowing through the device in order to maintain a fairly uniform water pressure in the water passing through the outlets.

SUMMARY OF THE INVENTION

The present invention comprises an irrigation device which receives water from a water supply line, lowers the pressure of that water, and then distributes it to a plurality of water conduits, including means for controlling the flow of water through each of those conduits. The device preferably includes a housing having a lower end adapted to connect to a water supply line, such as the riser of a sprinkler system. A pressure reducing element, preferably seated on an annular collar downstream of the connector means, self-adjusts for changes in the pressure of the water flowing through the device. Downstream of the pressure reducing element is an upper, manifold chamber in the interior of the housing. A cap removably secured to the housing completes the manifold chamber and permits access to the interior of the housing.

Around the inner circumference of the manifold chamber are positioned a plurality of outlets. In a preferred embodiment, these outlets are formed in the otherwise closed ends of cylindrical sockets, each of which has an open end in communication with the exterior of the device. A tubular element with an inlet and an outlet is fitted into each of these sockets in the manifold chamber, such that the inlet of the tubular element fixedly communicates with the outlet in the socket. A small-diameter flexible hose is then fitted to the outlet of the tubular element. Producing the housing and the tubular elements as separate pieces provides for ease of manufacture; however, it is to be understood that the housing and tubular elements could be produced as a unitary body.

The other end of the hose connected to the outlet of the tubular element is joined to a valve on a stake that is inserted in the ground. The flow of water through the stake valve may be controlled by the manipulation of a handle attached to the stake valve. Water flowing through the valve may be utilized at the valve outlet or the valve may be connected to another conduit to direct the water to a specific area in need of irrigation by drip or spray.

The present invention thus allows control over the flow of water to a desired location at a point near to that location. It is thus particularly useful in situations in which it is desirable to provide various locations with different amounts of low-pressure water.

The present invention further comprises a pressure reducer which, in one form, is positioned in a lower chamber of the housing upstream from the manifold chamber. The pressure reducer element includes a valve member that controls flow through an inlet orifice in the housing and is exposed to a high inlet pressure. A much larger area of the pressure reducer element downstream of the opening is exposed to a reduced downstream pressure. Thus, the high input pressure reacting against a small area is balanced with a lower pressure applied against a larger area in such a manner as to provide a desired output pressure. A reduced pressure can be maintained within a fairly narrow range with typical input water pressures using this form of the pressure reducer. In a preferred embodiment, a spring in the lower chamber of the housing engages the pressure reducer element and tends to urge it away from the inlet end of the housing. This creates what might be accurately termed a pressure regulator.

The housing of the present invention further contains a screen positioned in the upper chamber of the housing to keep obstructions away from the water outlets. The outer edge of this screen fits snugly against the cylindrical sockets and the bottom wall of the upper chamber. The screen is preferably shaped to limit upward travel of the pressure reducer element.

The present invention further includes an outer casing or canister which supports an inlet pipe connected to the inlet end of the housing of the irrigation device. The canister surrounds the housing of the irrigation device, which may be accessed by removing a cap on the upper end of the canister. The walls of the canister further contain openings to allow water conduits attached to the irrigation device to exit the canister.

BRIEF DESCRIPTION OF THE DRAWINGS

FIG. 5 is a plan view of the housing.

FIG. 6 is a cross-sectional view along line 6—6 of FIG. 7 of the tubular element.

FIG. 7 is a cross-sectional view of the housing and tubular elements along line 7—7 of FIG. 5.

DETAILED DESCRIPTION OF THE PREFERRED EMBODIMENT

Figure 1:
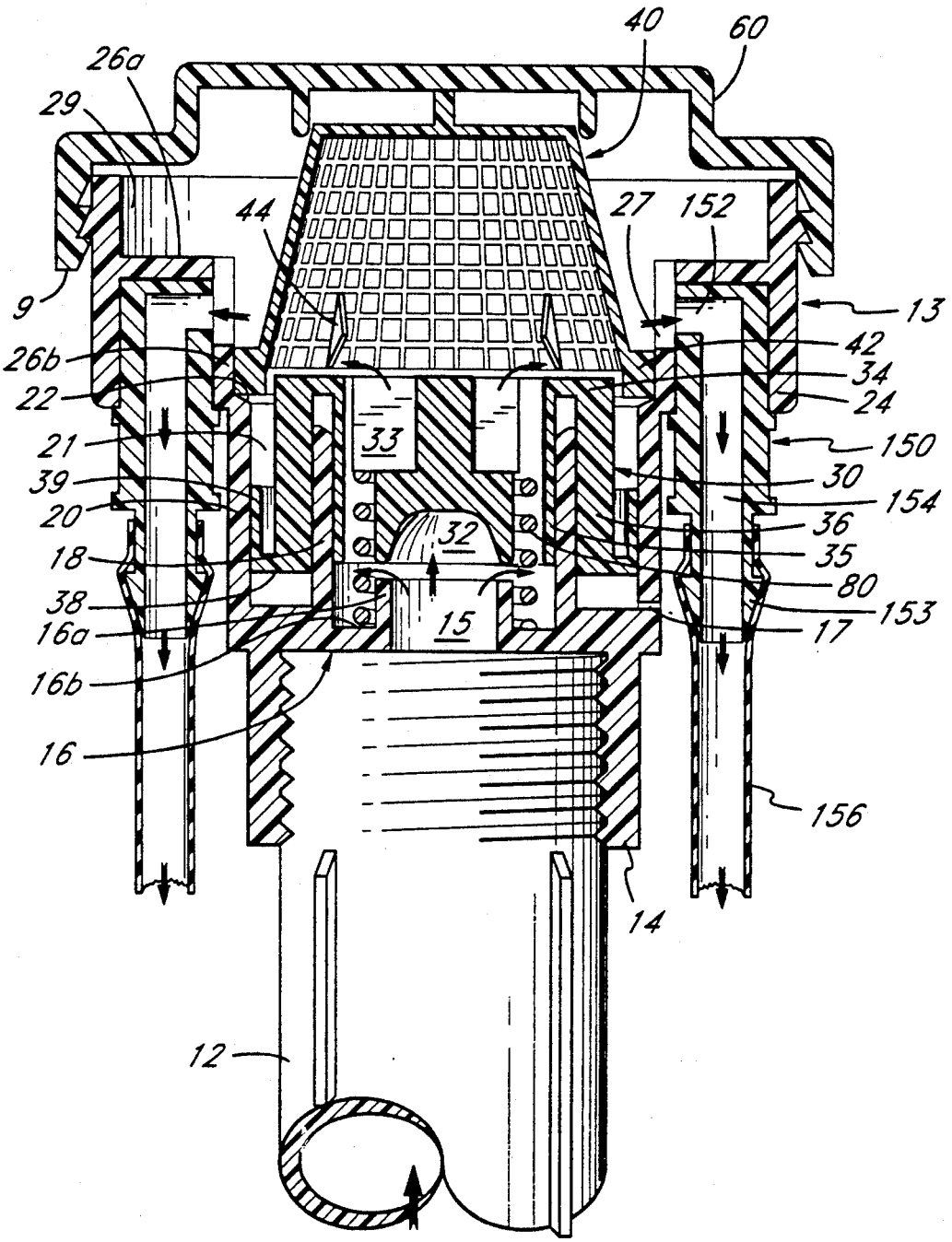
FIG. 1 is a cross-sectional view along line 1—1 of FIG. 10 of the housing and tubular element of the present invention.

Referring to FIGS. 1-4, a preferred embodiment of the present invention includes an outer, generally cylindrical canister or casing 10, a tubular conduit or riser 12 concentrically positioned within the casing, a housing 13 connected to the upper end of the conduit 12, a pressure reducer element 30 which fits within the lower portion of the housing 13, a screen 40 and a plurality of tubular elements 150 positioned within an upper portion of the housing 13, and a cap 60 enclosing the housing's upper end. Also included is a cover 70, shown in FIG. 10, which fits onto the upper end of the canister 10.

Referring now to FIG. 1, it may be seen that the housing 13 is a generally cylindrical or tubular body having sections of various diameters, concentrically arranged around the longitudinal axis of the housing. Preferably, the housing 13 is molded as a single component out of suitable rigid plastic. A lower tubular end 14 of the housing 13 forms a conduit for connection to the riser 12. Located at the upper portion of the lower end 14 is an orifice 15 defined by the inner edge of a radially inwardly extending wall or flange 16. The upper end of the orifice 15 is defined by a circular rim 16*a* which forms an inlet valve seat for the reducer element 30. Concentrically spaced outwardly from the valve seat is a generally cylindrical inner wall 18, which is joined to the rim 16*a* by a flat annular flange section 16*b*. Spaced outwardly from the inner wall 18 is an outer housing wall 20 which is joined to the inner wall by a generally flat annular flange section 16*c* (shown in FIG. 7). The walls 18 and 20 define an annular cavity 21 which is closed at its lower end and open at its upper end.

Formed integrally with the upper end of the outer wall 20 is a radially, outwardly extending, generally flat annular wall 22 which is a lower wall of a manifold chamber. The outer periphery of this wall is joined to an upwardly extending, generally cylindrical, outer manifold wall 24.

Formed integrally with the manifold walls 22 and 24 are a plurality, nine as shown, sockets 26, which are circumferentially spaced around the manifold walls as seen in FIG. 5. Referring again to FIG. 1, it may be seen that the sockets have an open lower end in the lower manifold wall 22, a closed upper end 26*a* and a generally cylindrical sidewall 26*b*, with the outer manifold wall 24 forming a portion of each socket sidewall 26*b*. Each socket has a generally rectangular outlet 27 on the upper end of its radially inner side of the sidewall 26*b*, adjacent the closed end 26*a* of the socket. Thus, it may be seen that the manifold walls 22 and 24, together with the housing cap 60, form a manifold chamber 29 leading to the plurality of outlets 27 in the manifold and the inlets to the sockets 26.

Tubular elements 150 fit into the sockets 26 and extend downwardly from the housing lower wall 22. An inlet 152 in each of the tubular elements 150 is aligned with the outlet 27 in each of the sockets 26 such that the interior of the manifold chamber 29 is in communication with an interior passage 154 in the tubular element 150. The tubular element 150 is preferably press-fit into the socket 26 of the housing 13 and extends downwardly from the lower wall 22 of the housing 13. The lower end of the tubular element 150 is also preferably formed with a barbed fitting 153 for easy friction connection to a conduit 156, which is preferably made from flexible tubing.

Figure 4:
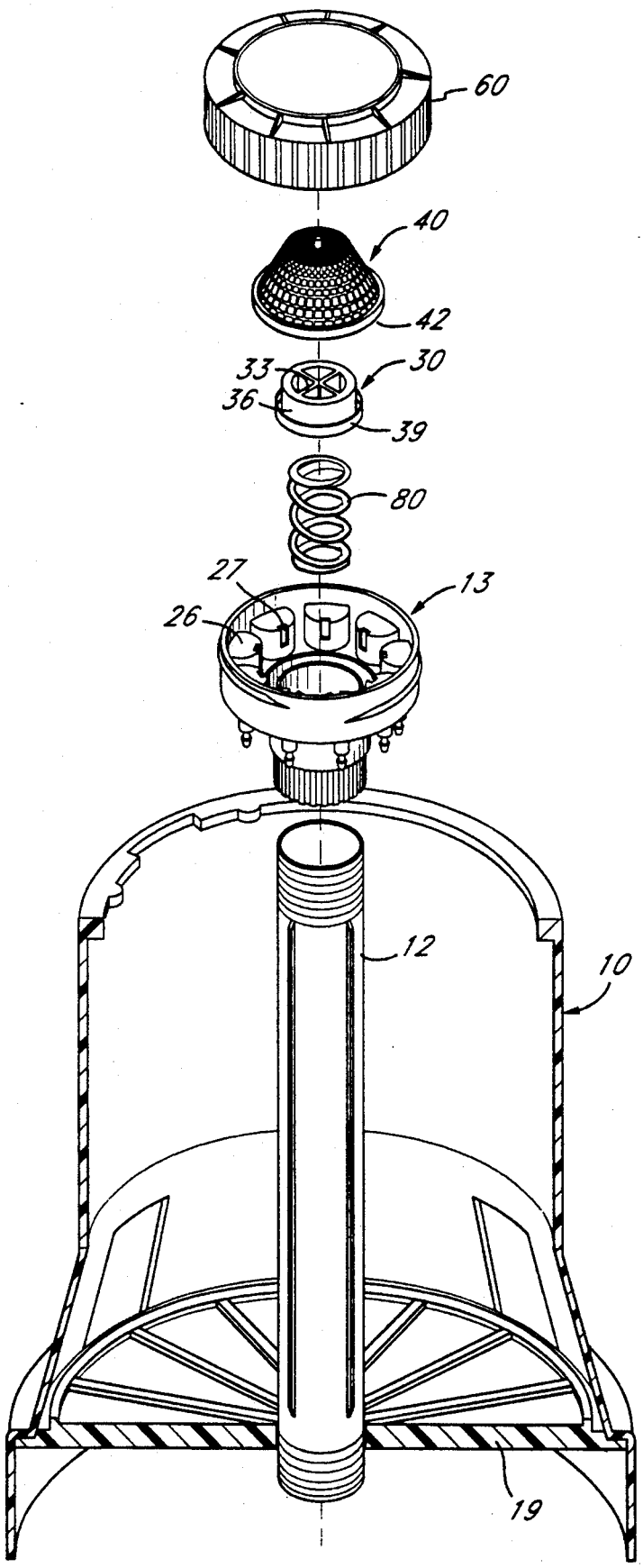
FIG. 4 is an exploded perspective view of a preferred embodiment of the present invention including a partial cut-away view of the canister of the present invention surrounding an inlet pipe.

Referring to FIGS. 1 and 4, the pressure reducer element 30 is a multi-walled element which is preferably molded as one piece and made of a suitable plastic which is relatively rigid when reasonably thick, but somewhat flexible when formed as a thin wall. The reducer element 30 includes a centrally positioned valve member 32 having a generally cylindrical lower end that cooperates with the valve seat 16*a* to meter liquid flow through the device. An upper, smaller diameter cylindrical portion of the valve member 32 is formed integral with a plurality of radially extending ribs 33, best seen in FIG. 4. The ribs 33 are connected on their outer extremities to a generally flat annular wall 34 and to an inner, thin, generally cylindrical sealing wall or flap 35. Also connected to the flat annular wall 34 is a downwardly extending, thicker cylindrical, outer wall 36. As seen from FIG. 1, the inner and outer walls 35 and 36 define an annular space open on its lower end such that the walls slidably fit onto the upwardly extending inner housing wall 18. The lower end of the outer housing wall 36 is joined to an outer, generally flat annular wall 38 and a short, thin, upwardly extending outer sealing wall or flap 39. As seen from FIG. 1, the walls 36, 38 and 39 have a generally U-shaped cross section and slidably fit within the annular space 21 formed between the inner and outer housing walls 18 and 20, with the wall 39 sealingly engaging the outer housing wall 20.

As also seen from FIGS. 1 and 4, the screen 40 has a generally frusto-conical, basket-like shape which is situated in the manifold chamber 29 with its open end facing downwardly towards the reducer element 30, and its upper end engaging the lower surface of the cap 60. The lower end of the screen 40 includes a relatively rigid peripheral flange 42 that fits snugly within the circle defined by the inner edges of the socket sidewalls 26*b*, with the flange engaging an inner shoulder of the housing lower wall 22. Note that the flange 42 is located below the manifold outlets 27. The inner side of the screen has four stops 44 that limit upward movement of the element 30.

Figure 2:
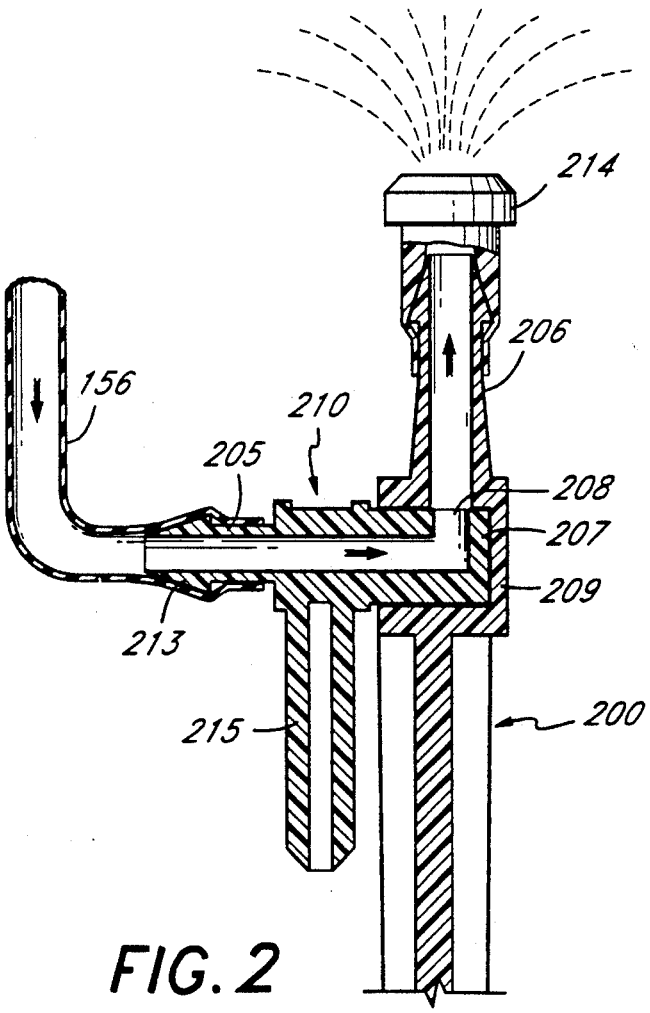
FIG. 2 is a cross-sectional view along line 2—2 of FIG. 10 of the upper portion of the stake of the present invention, including a sprinkler device attached to the stake.

Referring to FIG. 2, the other end of the conduit 156 is connected to a tube 205 on a stake 200 located at a point remote from the riser 12 and the housing 13. This tube also preferably has a barbed fitting 213 for easy friction connection to the conduit 156. The tube 205 is preferably oriented horizontally with respect to the stake 200.

The stake has a horizontally oriented tube closed on one end to form a socket 209 at its upper end through which a tubular stake valve 210 is inserted. The valve is in the form of a small diameter tube integral with the tube 205 which is closed at one end 207 but which has an opening 208 in the sidewall of the tube near end 207 such that the opening 208 may selectively communicate with the central passageway of an upwardly oriented tube 206. The opening 208 and the tube 206 are axially aligned with the stake body. The valve is preferably press-fit into the socket 209 in a manner so as to retain the valve 210 while permitting it to freely rotate in the socket 209 around the long axis of the tubular valve 210 by means of a radially extending handle 215. The closed end of the socket 209 conveniently limits the insertion of the valve 210 so that the opening 208 is aligned with the tube 206 when the valve 210 is inserted into the socket 209. A sprinkler 214 may be attached to the tube 206, as illustrated in FIG. 2, or water may exit that tube directly to provide drip irrigation. In addition, the stake 200 may comprise one or more clips 217 as shown in FIG. 10 for holding and giving support to other irrigation hoses not connected to the stake.

Figure 3:
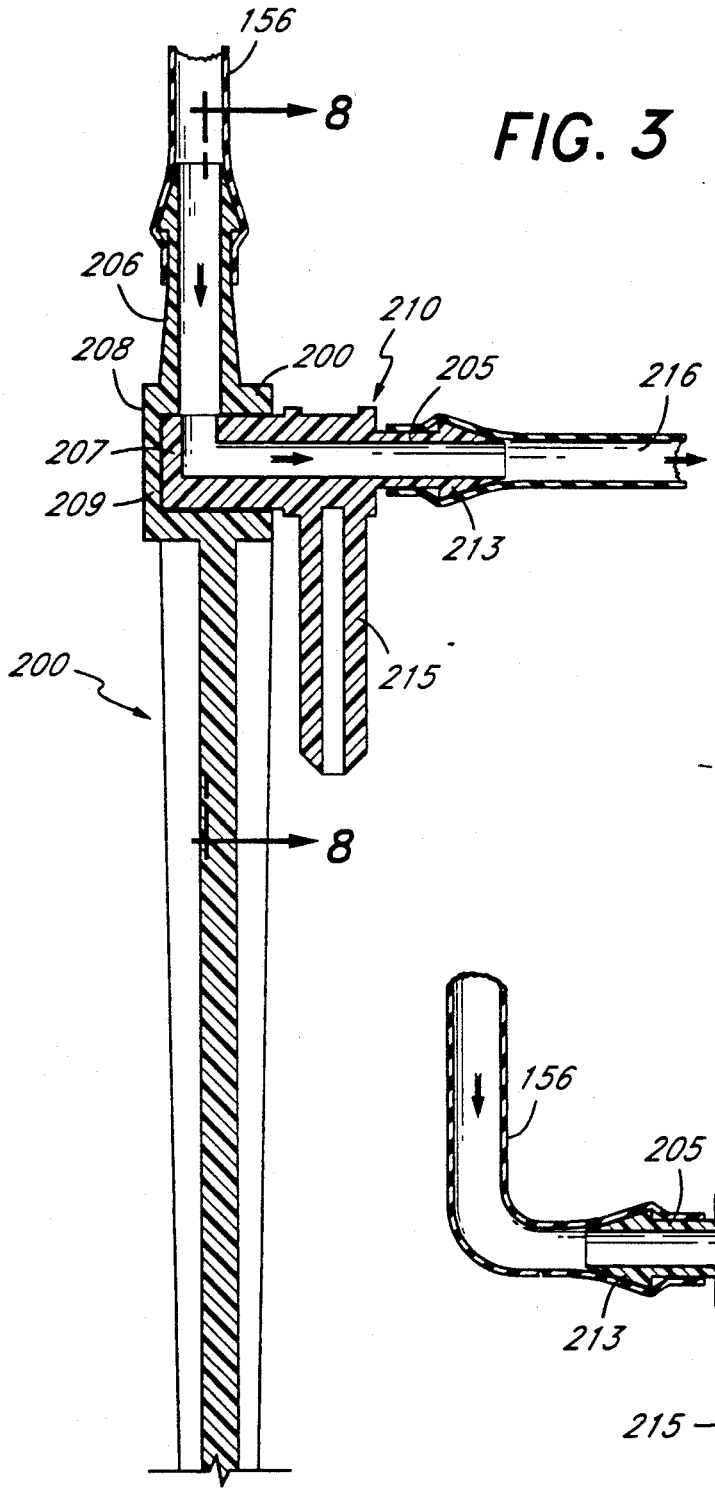
FIG. 3 is also a cross-sectional view along line 2—2 of FIG. 10 of the upper portion of the stake, showing an alternate way in which conduits might be connected to the stake.

In an alternate arrangement shown in FIG. 3, the flexible hoses 156 may be connected to the vertically-oriented tube 206 rather than to the horizontally-oriented tube 205. Flexible tubing 216 is then connected to the tube 205 by means of the barbed outlet or fitting 213. The tubing 216 receives the water passing through the tubular stake valve 210 and conducts it to a desired location.

Figure 10:
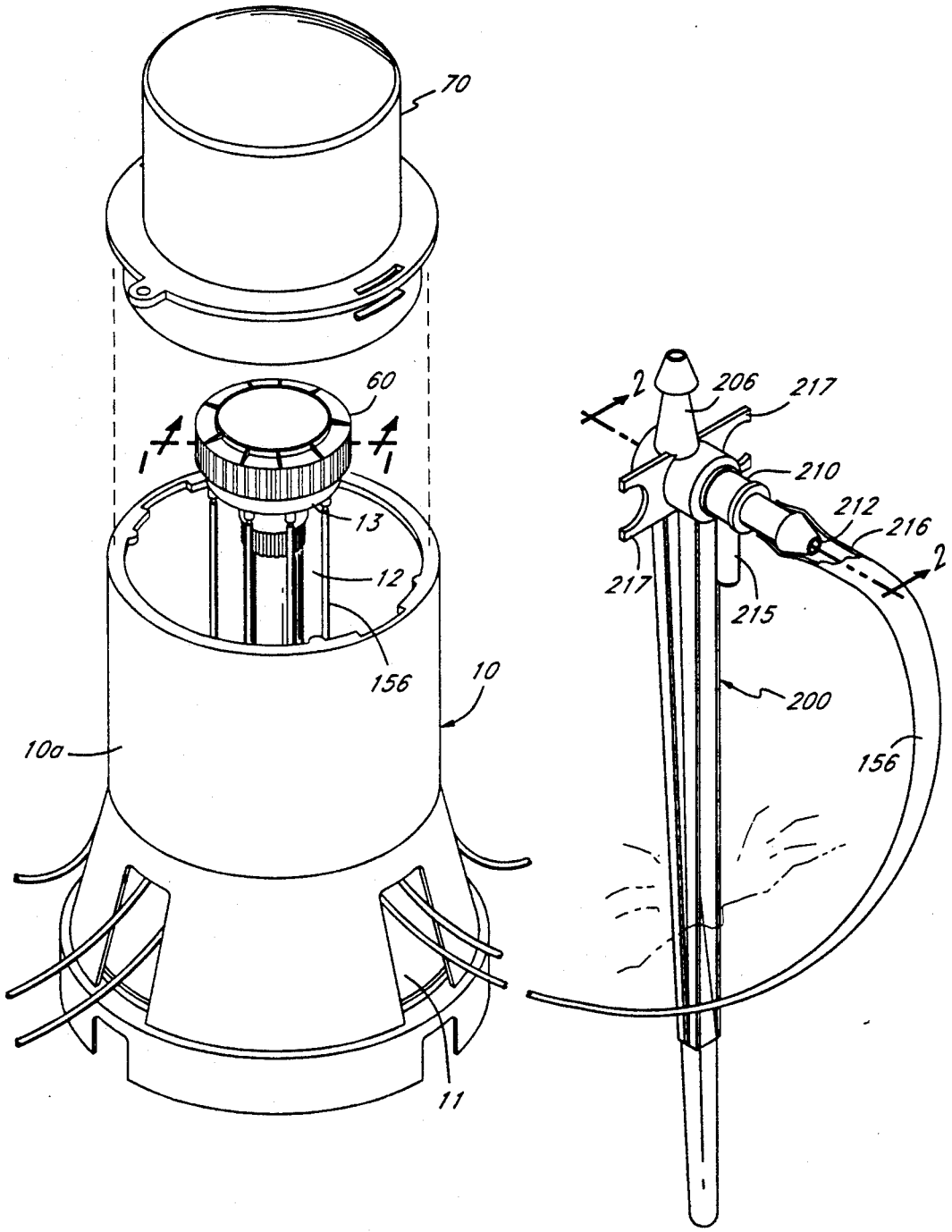
FIG. 10 is a perspective view of the present invention, including the canister.

Referring to FIGS. 4 and 10, it may be seen that the canister 10 has a generally cylindrical shape with a lower frusto-conical portion **10*a* having a plurality of circumferentially spaced holes 11 through which the tubes 156 extend. The canister is further provided with a relatively thick flat lower wall 19 which supports the conduit or riser 12, together with the components of the device on the upper end of the riser. The upper end of the canister 10 terminates slightly below the housing 13 so that the housing is readily accessible for maintenance. The generally cup-shaped cap 70 extends over these upper components and mates with the upper end of the canister. It should be understood that the canister 10 is an optional item and that the housing 13** with its components may simply be mounted directly on the upper end of a riser that is a part of an irrigating system.

Figure 11:
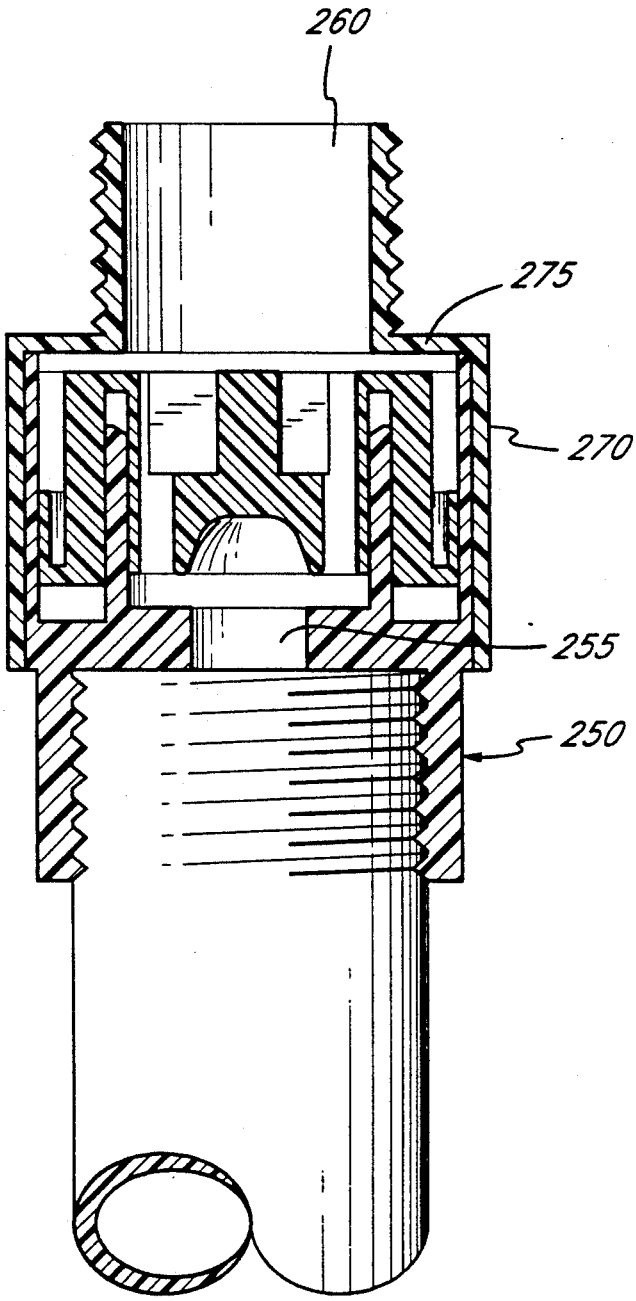
FIG. 11 is a cross-sectional view of housing and the pressure reducer element in a housing in another embodiment of the present invention.

Referring to FIG. 11, it may be seen that the pressure reducer 30 is useful in an arrangement other than the multiple outlet housing 13 shown in FIG. 1. The pressure reducer element 30 is shown in a housing 250 which is similar to the housing 13 of FIG. 1 except that it has only one outlet 260 positioned downstream from an inlet 255. The upward travel of the pressure reducer element 30 is stopped by an inwardly extending wall 275 which is part of an outlet casing 270. A spring (not shown) may optionally be used to urge the pressure reducer element in the open position. The pressure reducer element 30 thus acts to reduce the pressure of water entering the housing 250 in essentially the same way as in the embodiment of FIG. 1, but the device is useful as a pressure reducer or regulator in any in-line situation.

OPERATION

In use, the lower end of conduit 12 is connected to a source of water. After relatively high pressure water has entered the device through orifice 15, the pressure reducer 30 acts to lower the pressure of that water so that relatively lower pressure water leaves the housing 13 and passes through the tubular element 150. Small diameter, flexible hoses 156 are connected to the lower ends of the tubular elements 150, and water is conducted through these hoses to a plurality of stakes 200 located at points remote from the housing 13. Tubular valves 210 in the stakes 200 may then be individually manipulated to control the flow of water through the stakes.

Figure 8:
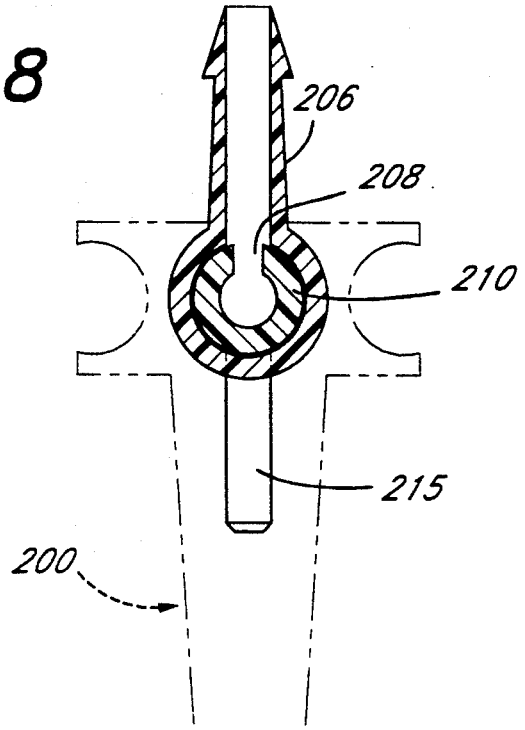
FIG. 8 is a cross-sectional view along line 8—8 of FIG. 3 showing the tubular stake valve of the present invention in a fully open position.
Figure 9:
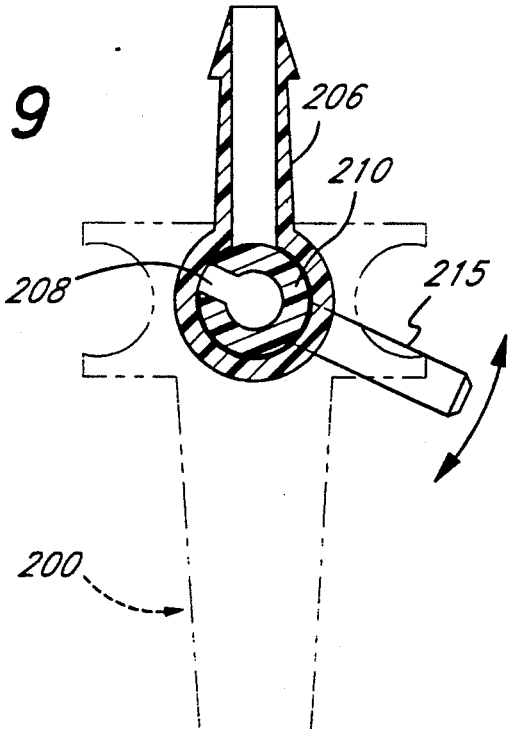
FIG. 9 is a view similar to that of FIG. 8 but showing instead the tubular stake valve of the present invention in a closed position.

To operate the valve 210, the handle 215 is rotated in order to open, close, or partially close the valve and thereby regulate the flow of water through the valve. FIG. 8 illustrates the valve in an open position wherein the inlet 208 of the tubular valve is aligned with the passageway of the tube 206. FIG. 9 shows the valve in the closed position. Of course, by rotating the handle 215 through a smaller arc, the valve 210 may be positioned to permit a lesser flow than in the fully open position illustrated in FIG. 8.

The inlet water pressure in the housing of the device, of course, varies from location to location, but typically is in the range of 20–80 psi. It is desirable that this pressure be reduced before the water reaches the tubular stake valves 210. Reducing the pressure minimizes downstream leaking problems and facilitates the use of flexible plastic distribution tubing. Also, reduced pressure allows the openings through the outlet valves to be larger than with higher pressure for a desired liquid flow. While various reduced pressures may be employed for satisfactory operation, it is desired that the inlet water pressure be reduced to a range of 15 to 20 psi. Advantageously, such pressure is sufficient to operate irrigation spray devices.

The inlet water pressure reacts against the lower surface of the reducer element valve member 32, urging the reducer element 30 upwardly in a direction to increase the flow through the orifice 15. The water then flows upwardly, as indicated by the arrows in FIG. 1, through the spaces defined by the ribs 33 in the reducer element 30, through the holes in the screen 40, radially and outwardly through the outlet holes 27. Due to the restricted flow through the orifice 15, the water pressure on the downstream side of the orifice is reduced from the water inlet pressure. This lower pressure, however, reacts against a much larger area than does the inlet pressure. That is, the inlet pressure reacts solely against the downwardly facing surface of the valve member 32. The effective area of this surface is the circular cross section of the lower end of the cylindrical valve member 32. The reduced downstream pressure on the element 30 is, however, applied to a much larger area. This includes the upwardly facing surfaces of the valve member 32, the ribs 33, the upper, flat annular wall 34, and the outer, lower, flat, annular wall 38. This combined upwardly facing surface multiplied by the downstream pressure produces a force that urges the reducer element 30 downwardly in the valve closing direction. Thus, an increased inlet pressure urges the reducer element open, but this increased downstream pressure tends to urge the valve element closed. This produces a generally balanced condition with a desired downstream pressure and with typical water inlet pressures.

It should be noted that the design of the pressure reducer element and the cooperating housing walls is such that the liquid flow is confined to that indicated by the arrows in FIG. 1 in that the liquid pressure downstream of the orifice 15 urges the large cylindrical sealing flap 39 into engagement with the housing inner wall 18. Likewise, the downstream pressure urges the outer cylindrical wall or flap 39 into sealing engagement with the outer housing wall 20. Thus, water pressure is not applied to the downwardly facing surfaces of the reducer element except the end of the valve member 32. Also, a small air vent 17 in the housing flange prevents pressure buildup between the flange **16*c* and the reducer element wall 38, and the walls 35 and 39** prevent liquid leakage out of the housing.

One of the advantages of the pressure reducer is that it is useful in some applications without a spring biasing force, thereby eliminating the cost and attendant wear problem of the spring; however, a spring may be optionally employed. Referring to FIG. 1, a coil compression spring 80 may be positioned between the inner cylindrical wall 35 of the reducer element and the centrally positioned valve member 32. The lower end of the spring engages the fixed annular flange **16*b* of the housing, while the upper end engages the lower edges of the ribs 33; and urges the reducer element 30 upwardly. With the use of the coil spring, the amount of pressure reduction obtained is decreased, such that the downstream pressure is larger than without the spring. Also, the reduced pressure is more constant because of the spring such that the arrangement may more accurately be referred to as a pressure regulator. The spring arrangement is perhaps desirable when the irrigation device is to be used with spray-type outlets on the end of the conduits 156, 216**.

It has been found that with a system using a regulator spring 80 and valves 150 having an inner tubular diameter of a little less than a tenth of an inch, an output of about 2½ gallons per minute (150 gallons per hour) for the entire device can be obtained. Such flow is much greater than that desired or needed for drip irrigation situations, but is quite useful for spray irrigation devices. Several of such spray devices can be operated with one of the multiple irrigation devices of the invention. Reduced flows can of course simply be obtained by adjusting the valves.

We claim:

1. An irrigation device, comprising:

a housing having an inlet end for connection to a source of liquid;

an outlet connected to a conduit for carrying the liquid to a location remote from said housing;

a stake for positioning at said remote location and having a tubular socket on its upper end with a hole in its side wall, a tube extending outwardly from said hole; and a tubular valve element positioned in said socket, said element having an opening near one end for selective communication with said socket hole, said socket and said tube together with said valve element defining a passage, one end of which is connected to said conduit and other end forms a water outlet, said element having a handle which may be manipulated to rotate said element to selectively align said element opening with said socket hole to control the flow of water through said passage.

2. The device of claim 1, further comprising a plurality of outlets for carrying said liquid to a plurality of stakes positioned in locations remote from said housing.

3. The device of claim 1, additionally comprising a pressure reducer element positioned in said housing downstream from said inlet for reducing a relatively high liquid input pressure to a relatively low output pressure.

4. The device of claim 1, wherein said outlet comprises an aperture in a cylindrical socket, said cylindrical socket having an end open to the exterior of the device and a closed end positioned inside the housing.

5. The device of claim 1, further comprising a screen positioned in said housing between said inlet and said outlet.

6. The device of claim 1, further comprising a vertically extending pipe connected to the inlet end of said housing, a tubular canister surrounding said pipe and spaced outwardly from said pipe, and a support member extending between the canister and the pipe to support the pipe, said canister having an open upper end and a cup-shaped cover which mates with the upper end of said canister.

7. The device of claim 6, wherein said canister has a side wall having a plurality of holes through which conduits may extend outwardly.

8. The device of claim 1, wherein said housing has a removable cap that facilitates access to the interior of said housing.

9. The device of claim 1, including clips on said stake for holding and supporting conduits whose outlet and inlet ends are not connected to said stake.

10. The device of claim 1, wherein said tubs is positioned axially above said stake.

11. An irrigation device, comprising:

a housing having an inlet end for connection to a source of liquid, said housing including an inwardly extending flange defining a liquid inlet hole, said housing further including a cylindrical inner wall extending axially towards an outlet end, said wall being spaced outwardly from said hole, said housing further having an outer side wall spaced outwardly from said inner wall;

a pressure reducer element positioned in said housing downstream from said inlet hole for reducing a relatively high liquid input pressure to a relatively low output pressure, said element extending across said housing and including portions in sliding engagement with said inner and outer housing cylindrical walls, said reducer element further including a centrally positioned valve member which is supported by spaced ribs extending inwardly from outer portions of said element, said valve member extending axially towards said housing flange to cooperate with said inlet hole to control liquid flow through said hole, said valve member having an upstream face exposed to high inlet liquid pressure urging said element in a valve opening direction, said element having a downstream facing surface much larger than said upstream face, said downstream facing surface being exposed to lower liquid pressure downstream of the inlet hole and providing a force urging said element into a valve closing position, the differential between opening and closing liquid pressure forces being balanced so as to provide a substantial pressure reduction downstream of said inlet hole with fluctuating inlet pressures;

an outlet from said housing connected to a conduit for carrying the relatively low output pressure liquid to a location remote from said housing;

a valve connected to said conduit which may be manipulated to control the flow of water out of said conduit.

12. The device of claim 11, wherein said outlet comprises an aperture in a cylindrical socket, said socket having an end open to the exterior of the device and a closed end positioned inside the housing.

13. The device of claim 11, wherein said housing includes a lower chamber in which said pressure reducer element is positioned, and an upper, larger diameter chamber having a lower wall which extends outwardly from said lower chamber and forms a shoulder, said sockets being positioned in said lower wall.

14. The device of claim 13, further comprising a screen positioned in the upper chamber of said housing between said pressure reducer element and said outlet.

15. The device of claim 14, wherein the edges of said screen are shaped to fit snugly against the sidewall of said socket.

16. The device of claim 11, further comprising a vertically extending pipe connected to the inlet end of said housing, a tubular canister surrounding said pipe and spaced outwardly from said pipe, said canister having an open upper end and a cup-shaped cover which mates with the upper end of said canister.

17. The device of claim 16, wherein said canister has a side wall having a plurality of holes through which conduits may extend outwardly.

18. The device of claim 11, wherein said housing has a removable cap that facilitates access to the interior of said housing and to said pressure regulator.

19. An irrigation device, comprising:

a housing having an inlet for connection to a source of liquids;

a pressure reducer element positioned in said housing downstream from said inlet for reducing a relatively high liquid input pressure to a relatively low output pressure;

a plurality of outlets in said housing;

a vertically extending pipe connected to said inlet;

a tubular canister surrounding and spaced outwardly from said pipe, said canister having an open upper end that terminates in the area of said outlets and said housing, said canister further including a cup-shaped cover which enclosing said housing and mates with the upper end of the canister so that when said cover is removed said housing is essentially completely accessible;

stakes located remote from the housing, each of which supports an adjustable valve to regulate the flow of liquid passing through said valve; and conduits each of which is respectively connected to one of said housing outlets at one end and connected to one of said valves at the other end.

20. A pressure reducing device, comprising:

a housing having an inlet for connection to a source of liquid;

a cylindrical inner wall in said housing formed around said inlet and extending axially away from said inlet; and a pressure reducer element having an outer generally cylindrical wall and an inner general cylindrical wall spaced inwardly from said outer wall, said element walls being joined at one end, said element walls being spaced and sized to slidably fit onto said housing inner wall in such a manner that the inner element wall sealingly engages the inner surface of the inner housing wall, said outer element wall carrying means on its lower end for sealingly engaging the inner surface of the outer housing wall, said pressure reducer element further having a centrally positioned valve member, said valve member being adapted to cooperate with the inlet in the housing to control the flow of liquid through the housing.

21. A pressure reducing device, comprising:

a tubular conduit having formed therein an inwardly extending flange defining a liquid inlet hole, said flange being spaced from an outlet end of the conduit and defining a space with the conduit for receiving a movable pressure reducer element;

a cylindrical inner wall formed integral with said flange and extending axially towards the outlet end of the conduit, said inner wall being outwardly spaced from said hole and inwardly spaced from an outer side wall of the conduit; and a pressure reducer element having an outer generally cylindrical wall and an inner generally cylindrical wall spaced inwardly from said element outer wall, said element walls being joined at one end by a flat annular wall, said element cylindrical walls being spaced and sized to slidably fit onto said conduit wall in a manner such that the inner element wall sealingly engages the inner surface of said conduit inner wall, and the outer element wall carries means on its lower end which sealingly engages the inner surface of the outer wall of the conduit, said reducer element further having a centrally positioned valve member which is supported by spaced ribs extending inwardly from said inner reducer wall and said reducer annular wall, said valve member being adapted to cooperate with the hole in said flange to control liquid flow through said hole, and between said spaced ribs, said valve member having an upstream face exposed to high inlet liquid pressure in said conduit urging said element in a valve opening direction, the downstream facing surface of said element being exposed to lower liquid pressure downstream of the inlet hole and providing a force urging said element into a valve closing position, the differential between said opening and closing forces being balanced so as to provide a substantial pressure reduction with fluctuating inlet pressures.

22. The device of claims 20 or 21, including a spring for urging said element in a valve opening direction.

* * * * *